OTHER PUBLICATIONS

"Riding on Electrons", by D. Sherman, *Popular Science* Sep. 90.

"A Magnetic Bearing Control Approach Using Flux Feedback", by N. J. Groom, NASA Technical Memo. 100672, Mar. 1989.

"Performance of Magnetic Suspensions for High Speed Vehicles Operating Over Flexible Guideways", by C. A. Skalski, *Transactions of the ASME*, Jun. 1974.

US005524730A

United States Patent [19]

Roberts

[11] Patent Number: 5,524,730

[45] Date of Patent: Jun. 11, 1996

[54] METHOD AND APPARATUS FOR STORING SENSED ELEVATOR HORIZONTAL DISPLACEMENT AND ACCELERATION SIGNALS

[75] Inventor: Randall K. Roberts, Amston, Conn.

[73] Assignee: Otis Elevator Company, Farmington, Conn.

[21] Appl. No.: 309,566

[22] Filed: Sep. 20, 1994

Related U.S. Application Data

[63] Continuation of Ser. No. 67,405, May 25, 1993, abandoned, which is a continuation of Ser. No. 668,544, Mar. 13, 1991, abandoned.

[51] Int. Cl.[6] ..... B66B 1/24; B66B 3/00

[52] U.S. Cl. ..... 187/292; 187/391; 187/394

[58] Field of Search ..... 187/391, 393, 187/409, 410, 277, 292, 394

[56] References Cited

U.S. PATENT DOCUMENTS

| | | | |
|---|---|---|---|
| 3,871,301 | 3/1975 | Kolm et al. | 104/148 SS |
| 3,939,778 | 2/1976 | Ross et al. | 104/148 |
| 4,215,403 | 7/1980 | Pollard et al. | 364/424 |
| 4,507,738 | 3/1985 | Nozawa et al. | 364/474.29 |
| 4,617,502 | 10/1986 | Sakane et al. | 318/568.18 |
| 4,621,833 | 11/1986 | Soltis | 280/707 |
| 4,625,993 | 12/1986 | Williams et al. | 280/707 |
| 4,750,590 | 6/1988 | Otala | 187/95 |
| 4,754,849 | 7/1988 | Ando . | |
| 4,770,438 | 9/1988 | Sugasawa et al. | 280/707 |
| 4,809,179 | 2/1989 | Klinger et al. | 364/424.05 |
| 4,892,328 | 1/1990 | Kurtzman et al. | 280/707 |
| 4,898,257 | 2/1990 | Brandstadter | 180/9.1 |
| 4,899,852 | 2/1990 | Salmon et al. | 187/1 R |
| 4,909,535 | 3/1990 | Clark et al. | 280/707 |
| 5,020,639 | 6/1991 | Michel | 187/1 R |
| 5,027,925 | 7/1991 | Kahkipuro | 187/115 |
| 5,086,882 | 2/1992 | Sugahara et al. | 187/95 |
| 5,329,077 | 7/1994 | Skalski et al. | 187/133 |

FOREIGN PATENT DOCUMENTS

| | | | |
|---|---|---|---|
| 58-39753 | 9/1983 | Japan | B66B 7/02 |
| 60-15374 | 1/1985 | Japan | B66B 1/06 |
| 60-36279 | 2/1985 | Japan . | |
| 61-22675 | 6/1986 | Japan | B66B 7/08 |
| 63-87483 | 4/1988 | Japan | B66B 1/06 |
| 1-156293 | 6/1989 | Japan | B66B 11/02 |
| 1-197294 | 8/1989 | Japan | B66B 7/04 |
| 1-321283 | 12/1989 | Japan | B66B 7/02 |
| 1-321285 | 12/1989 | Japan | B66B 7/02 |
| 3-23185 | 1/1991 | Japan . | |
| 3-3888 | 1/1991 | Japan | B66B 11/02 |
| 3-3884 | 1/1991 | Japan | B66B 7/06 |
| 3-51280 | 3/1991 | Japan | B66B 5/02 |
| 3-51281 | 3/1991 | Japan | B66B 5/02 |
| 3-51279 | 3/1991 | Japan | B66B 5/02 |
| 3-124683 | 5/1991 | Japan | B66B 7/02 |
| 2181275 | 4/1987 | United Kingdom . | |

OTHER PUBLICATIONS

Database WPIL, Week 9030, Derwent Publications Ltd., London, GB; AN 90–224718 & FI–A–8804380.

"Development of an Inertial Profilometer" by E. L. Brandenburg, et al, ENSCO, Inc., prepared for the Federal Railroad Administration in Nov. 1974 and distributed by the National Technical Information Service.

"Inertial Profilometer as a Rail Surface Measuring Instrument" by T. J. Rudd & E. L. Brandenburg, a manuscript contributed by the Inter–society Committee on Transportation for presentation at the Inter–society Conference on Transportation, Denver, CO, Sep. 23–27, 1973.

(List continued on next page.)

*Primary Examiner*—Robert Nappi
*Attorney, Agent, or Firm*—Francis J. Maguire

[57] ABSTRACT

An elevator hoistway rail profile is made by summing a doubly integrated car horizontal acceleration signal with a relative rail-car displacement signal and storing the summed signal according to the vertical position of the car in the hoistway.

15 Claims, 8 Drawing Sheets

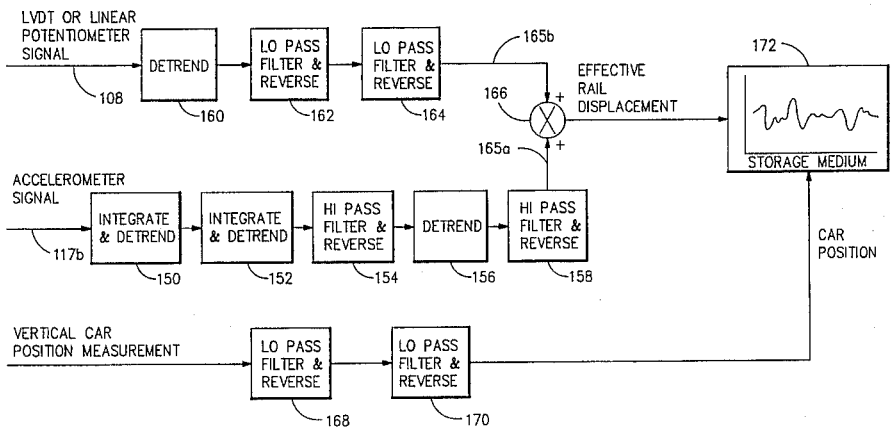

METHOD AND APPARATUS FOR STORING SENSED ELEVATOR HORIZONTAL DISPLACEMENT AND ACCELERATION SIGNALS

CROSS-REFERENCE TO THE RELATED APPLICATION

This is a continuation of application Ser. No. 08/067,405 filed on May 25, 1993 now abandoned, which is a continuation of application Ser. No. 07/668,544 filed on Mar. 13, 1991, now abandoned.

This application discloses subject matter which may be disclosed and claimed in application U.S. Ser. No. 07/068,546, abandoned in favor of U.S. Ser. No. 08/067/414, now abandoned in favor of U.S. Ser. No. 08/279,826, filed Jul. 25, 1994, filed on the same day as this application.

Technical Field

This invention relates to elevators and, more particularly, to ride quality.

Background Art

Maintaining or improving the ride quality of elevators will require implementation of new technologies, especially as the elevator speeds are increased. Reducing lateral motion of the car platform is important for improving ride quality. Such motion can be caused by rail-induced forces which are transmitted to the car through the rail guides due to rail irregularities.

If one were to design an automatic control system for reducing such lateral motion one could choose an open loop system.

At least one attempt to address rail-induced forces using an open loop control is shown in the literature. In U.S. Pat. No. 4,750,590, in order to compensate for lateral oscillation of an elevator car, Matti Otala discloses what appears to be an open-loop elevator control system with solenoid actuated guide shoes. The disclosure purports to show how to use the concept of first ascertaining the out-of-straightness of the guide rails for storage in a computer memory and subsequently controlling the guide shoes by recalling the corresponding information from memory and correcting the guide rail shoe positions accordingly.

However, the method shown in Otala's disclosure, of merely attaching acceleration meters to the elevator car, would not, as suggested by his disclosure, provide sufficient information to create a "deviation table" for a compensation system. It would merely create an acceleration table. How and why a "deviation table" is made and needed is not shown or suggested.

Even if one were to surmise enough to integrate Otala's acceleration signals twice to obtain displacement signals and store the displacement signals, instead of acceleration signals, in a dimensionally true displacement table, even such a table would not be usable in the anticipatory compensation system Otala shows.

As I see it, there are two principal disturbances which contribute to the levels of vibration in the car: (1) rail-induced forces which are transmitted to the car through the rail guides due to rail irregularities, and (2) direct-car forces such as produced by wind buffeting, passenger load, distribution or motion.

The various parameters of the elevator car's suspension system are so affected by unrepeatable direct-car forces that the underlying acceleration measurements, without more, would not be meaningful. In other words, the underlying accelerations are a nonlinear function of the car load, its distribution, the movement of passengers, and a myriad of other direct car forces. Something more is needed to interpret the sensed acceleration signals (or deviations integrated therefrom) in a meaningful context in order to be enabled to compile a displacement table that truly reflects the rail profile.

Disclosure of Invention

On the other hand, the teachings of the present invention show why it is necessary, and how to actually quantify, the cause of the first system disturbance, i.e., elevator guide rail irregularities.

According to the present invention, horizontal rail deviations from vertical are measured by relating a sensed car horizontal acceleration signal to a sensed signal indicative of the horizontal displacement of the car from the rail.

In further accord with the present invention, a sensed signal indicative of horizontal acceleration of an elevator car may be doubly integrated to provide a first displacement signal indicative of the horizontal displacement of the car with respect to an inertial reference system. A concurrently sensed, second displacement signal indicative of the displacement of the car with respect to a hoistway rail may be summed with the first displacement signal. The summed signal may be paired with a vertical position signal indicative of the position of the car in the hoistway at the time of the concurrent measurements.

Thus, according to the present invention, a signal indicative of an elevator car's horizontal displacement from a vertical inertial referent while the car is in vertical motion is compared to a signal indicative of the displacement between the car and rail and the resultant signal is related to another signal indicative of the vertical position of the car. The comparing and relating steps may be carried out as a number of samples throughout the vertical hoistway span in order to establish a rail profile which may be electronically stored in a lookup table or might even conceivably be done more or less continuously in an analog implementation.

The signal indicative of the car's horizontal displacement may be a doubly integrated acceleration signal from an accelerometer. Its sensing axis may be perpendicular to vertical and parallel to the side-to-side or front-to-back directions. The difference between such a signal and a signal indicative of the displacement between the car and rail is an actual indication of the rail profile, i.e., its bumpiness or "deviations" from vertical.

Thus, in light of the insights provided by the present invention, it will now be understood by those skilled in the art that a mere acceleration reading only gives one piece of information that is referenced to an inertial reference frame or a conceptual plumb line. Since the guide moves with respect to a referent such as the car, such needs to be measured. In the case of a wheel, since its movement with respect to the rail may be assumed to be fixed (e.g., a relatively stiff or even, for our purposes, incompressible wheel) or known (e.g., a sliding guide with actual sliding contact with the rail or an electromagnet actuator with a sensed electromagnetic gap), its movements with respect to the cab need to be known in order to be relatable to the same plumb line or inertial referent. This information is needed to create an actual rail profile with real rail displacement information.

The guide rail profile estimation invention disclosed in this patent is unique in that it provides a way for generating rail profiles with instrumentation that can be located only in or on the car, eliminating the need for plumb-lines or expensive optical equipment. The measurement instrumentation may consist of, e.g., three single axis accelerometers, four relative displacement transducers, and a vertical position measurement of the car in the hoistway. These signals are provided and may be stored in computer memory during a full vertical span run of the elevator car. A series of rail estimation steps may then be executed to process the data to synthesize rail profiles in the form of rail displacements (from plumb-line) as a function of the vertical position. This system permits rapid characterization of hoistway rail irregularities. Or the whole process could be done "on-the-fly".

In order to be in a position to ameliorate rail-induced disturbances, whether by an automatic compensation system, by manual means, or in order to be in a position to merely evaluate rails at a particular site, the disclosed "rail profile estimation" approach can actually be used to generate a profile of guide rails, that is, a graph, database, lookup table or the like, of rail displacement versus elevator vertical position. Whether used as part of an active suspension system to minimize car motion during elevator operation or for purposes of rail installation, re-alignment, etc., the disclosed rail profile estimation methods may be used on new elevators or may be used at existing installations. This disclosure shows an embodiment utilizing a wheel guide as the hardware used in part of the information gathering process but other types of guides, such as shown by Otala or by myself and others in, for example, U.S. Ser. No. 07/555,132, may be used as well.

The disclosed method provides a rail profile that may be used in an active system to reduce lateral car vibration levels by up to approximately 90%. Such compensation may be employed on new equipment or retrofitted to existing installations. The disclosed method has been validated as being highly robust and repeatable across a wide spectrum of speeds, directions, suspension stiffnesses, suspension preloads and car payloads.

These and other objects, features and advantages of the present invention will become more apparent in light of the following detailed description of a best mode embodiment thereof, as illustrated in the accompanying drawing.

BRIEF DESCRIPTION OF THE DRAWING

FIGS. 10(*c*), 11(*c*) & 12(*c*) show estimated car deviation from true vertical, being doubly integrated and filtered versions of the acceleration plots of FIGS. 10(*a*), 11(*a*) & 12(*a*), respectively, according to the teachings of the present invention; and FIGS. 10(*d*), 11(*d*) & 12(*d*) show estimated rail profiles vs. car vertical position which may be obtained by summing the signals of FIGS. 10(*b*), 11(*b*) & 12(*b*) with those of FIGS. 10(*c*), 11(*c*) & 12(*c*), respectively, according to the teachings of the present invention.

Best Mode for Carrying Out the Invention

Figure 1:
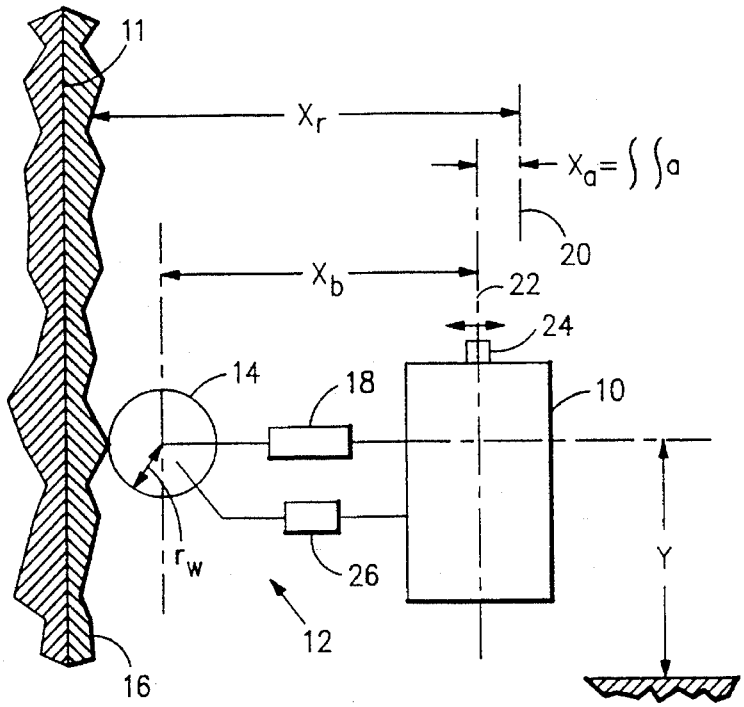
FIG. 1 illustrates a central teaching of the present invention.

FIG. 1 illustrates a central teaching of the present rail estimation invention as carried out on an elevator using conventional wheel guides. It should be understood, however, that the teachings hereof are applicable to other types of guides as well and are not restricted to merely roller-guide types of installations. An elevator car 10 for travelling up and down vertically as indicated by a vertical distance y in a hoistway is shown having a wheel guide 12 with a wheel 14 for riding on a rail 16 attached to a hoistway wall 11 and a spring 18 attached at one end to the wheel and the other to the car. Although this teaching is illustrated for side to side horizontal translations, it will be realized that the same basic principle is applicable to front to back translations as well.

With the car at rest, a horizontal distance $x_a$ between a vertical reference line 20, e.g., a vertical inertial reference or "plumb line" down the center of the hoistway, and a vertical centerline 22 of the car can be defined to zero. However, assuming the opposite rail is completely horizontal translations which will cause the distance $x_a$ to smooth, during vertical motion of the car, due to direct and rail induced forces, the car will experience various be nonzero. The magnitude of $x_a$ may be measured, e.g., using an accelerometer 24 and doubly integrating its output signal (*a*).

The horizontal translations will cause a distance $x_b$ between the wheel and the car to change and the magnitude of $x_b$ may be measured using a position sensor 26. It may be assumed that the wheel is relatively incompressible and has sufficient preload to prevent loss of contact with the rail during elevator operation. Thus, the summation of $x_a$ and $x_b$ will represent the deviation of the rail's surface from the reference line 20:

$$X_r = X_a + X_b + r_w,$$

where, $x_r$= rail displacement, $x_a$= car displacement, $x_b$= relative wheel to car displacement, and $r_w$= effective wheel radius (constant).

In this way, an actual rail deviation table may be compiled. The table will be indicative of rail displacement from a true vertical reference line.

Figure 2:
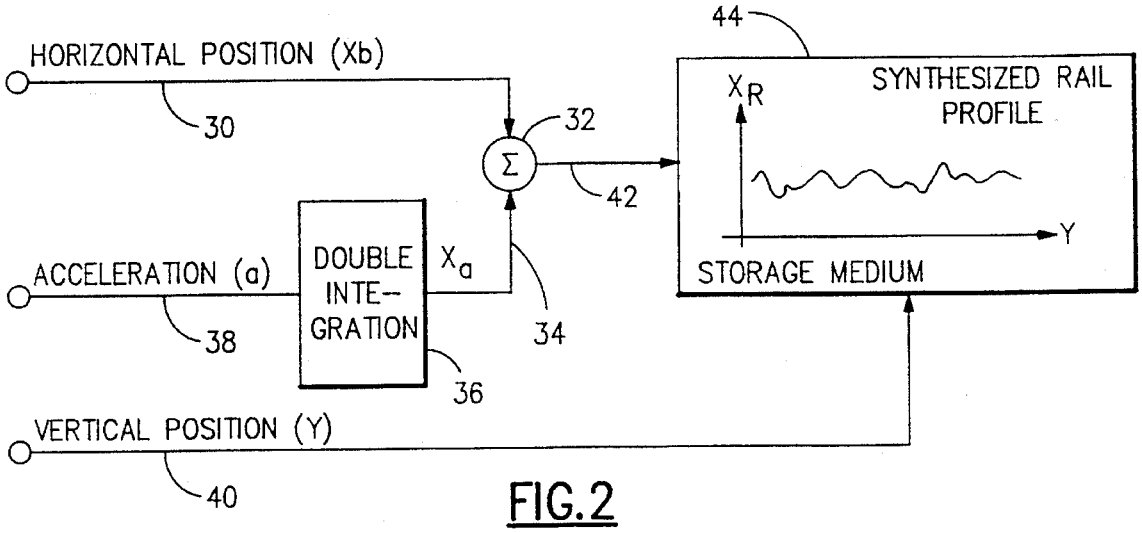
FIG. 2 shows a method of relating a sensed car acceleration signal to sensed horizontal and vertical displacement signals according to the present invention.

FIG. 2 illustrates a way to make such a rail deviation table. A horizontal position signal on a line 30 from a position sensor such as sensor 26 is summed in a summing junction 32 with another position signal on a line 34 from a signal conditioner 36 which double integrates an acceleration signal on a line 38 from an accelerometer such as the accelerometer 24. A vertical position signal on a line 40 indicative of the car's vertical position in the hoistway is provided, along with a summation signal on a line 42, to be paired therewith to form a table of positional data indicative of the magnitude of horizontal rail deviation from true vertical along the hoistway. An analog representation of such a table is shown in a box 44 by way of a graph on a Cartesian coordinate system although it should be realized that the table will typically be stored by way of samples in a digital memory for access by a digital signal processor.

Figure 3:
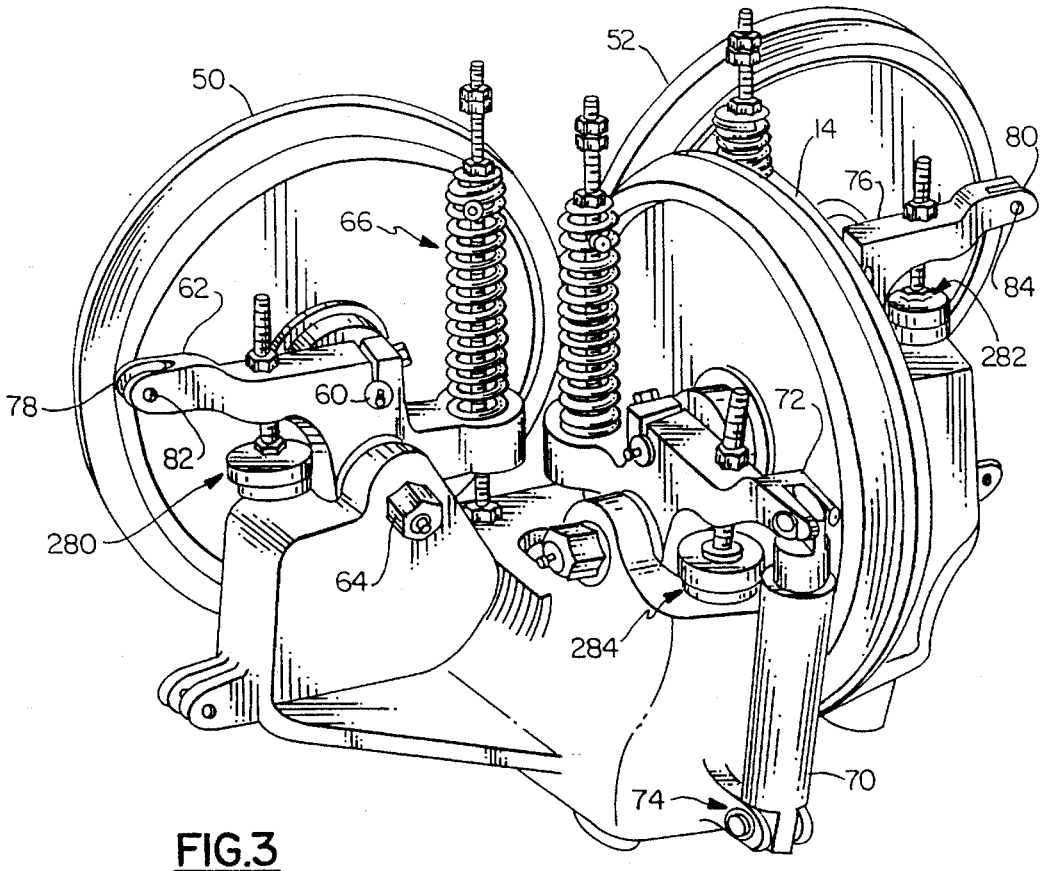
FIG.3 Prior Art
FIG. 3 shows a prior art roller guide.
Figure 4:
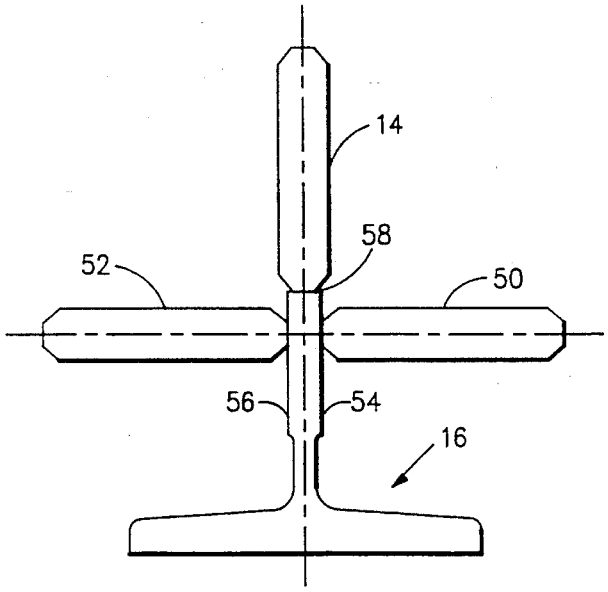
FIG.4 Prior Art
FIG. 4 shows the rollers of FIG. 3 from above as they would typically be situated on a rail.

A car may be instrumented to measure the side to side displacement $x_b$ depending on the type of guide. For an example of a typical guide, FIG. 3 shows a ten inch (25.4 cm) Otis roller guide 48 which may be found installed on numerous high speed elevators throughout the world. The guide is fixedly mounted on a car and front and back rollers 50, 52 roll on opposite faces 54, 56, respectively, of the hoistway rail 16, as shown in FIGS. 1 & 4 adjacent the car. The side to side roller 14 rolls on a distal face 58 of the rail.

The front to back roller 50 has its axle fixedly attached at a point 60 to an arm 62 which rotates about a point 64. An adjustable spring 66 preloads the roller 50 to exert a selected force against rail face 54. Rollers 52, 14 are set up similarly to roll on faces 56, 58, respectively. A side-to-side dashpot 70 is shown connected between an arm 72 and a bracket 74. The original design of the roller guide as shown in FIG. 3 made similar provision for front-to-back dashpot for the arm 62 and an arm 76 but the dashpots, at least for some cases, were apparently later found to be unnecessary. Consequently, at least some later versions were manufactured without openings and holes for the dashpot 70 as well as without the openings 78, 80 and the holes 82, 84. For more details, see U.S. Pat. No. 3,099,334 to Tucker issued Jul. 30, 1963.

It will be realized that the particular guide shown is not the only type of guide which may be instrumented to measure the relative displacement between the car and rail. Other types of rails such as sliding guides, electromagnet guides and many other types of guides are certainly within the scope of the invention. It is only necessary to instrument the selected type of guide in such a way as to measure the relative displacement between the car and rail.

Figure 5:
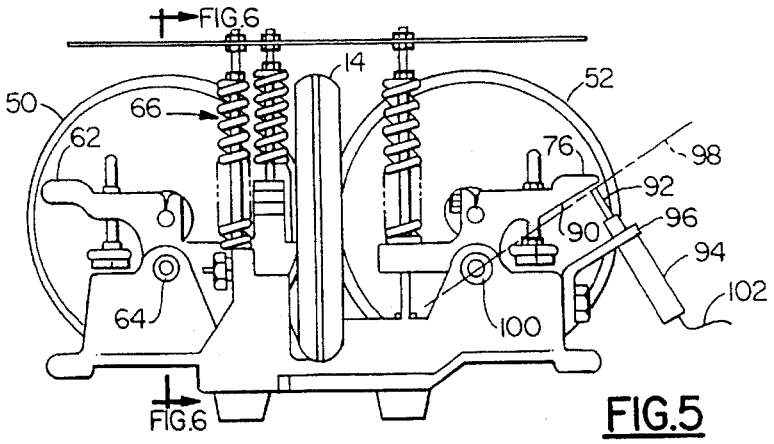
FIG. 5 shows the roller guide of FIG. 3 instrumented, according to the present invention for measuring-front-to-back displacement of the car from a rail.

FIG. 5 shows a sectional view of the wheel guide of FIG. 3 from the rear. The underside of arm 76 (without a through hole 84 or slot 80) is machined down to a planar surface 90 for sliding contact with a plunger 92 of a displacement transducer 94 mounted on a bracket 96 affixed to the body of the guide. If a line 98 in the plane 90 were extended as shown it would intersect a pivot point 100 for wheel 52 similar to pivot point 64 already described with respect to wheel 50. By setting up this geometry, one can readily linearize any test readings obtained to relate actual wheel displacement to measured rocker arm movement. For example, a shim of a certain thickness inserted between the wheel 52 and the rail face 56, temporarily disconnecting spring 60, might result in a displacement of the plunger 92 by a measurable factor of that thickness, for example, approximately twice. Any inaccuracy introduced by the sliding action of the tip of the plunger 92 against the surface 90 may be neglected. A signal on a line 102 from the sensor 92, 94 is provided.

Figure 6:
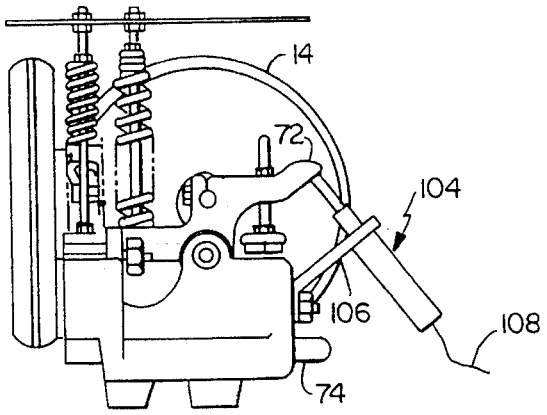
FIG. 6 shows the roller guide of FIG. 3 instrumented, according to the present invention for measuring side-to-side displacement of the car from a rail.

FIG. 6 is a side sectional view as shown in FIG. 5 from the left of the guide of FIG. 3, instrumented for measuring side-to-side displacement of the car relative to the rail. A displacement sensor 104 is mounted in a way similar to that described above for sensor 92, 94 on a bracket 106 attached to the guide body for providing a signal on a line 108 indicative of the displacement of the car from the rail surface 58.

It will be observed that the instrumentation of FIG. 5 provides for measuring the front to back displacement only of the deviation of rail surface 56 and not that of its opposite 54. This assumes uniform thickness of the rail which is an acceptable assumption.

Figure 8:
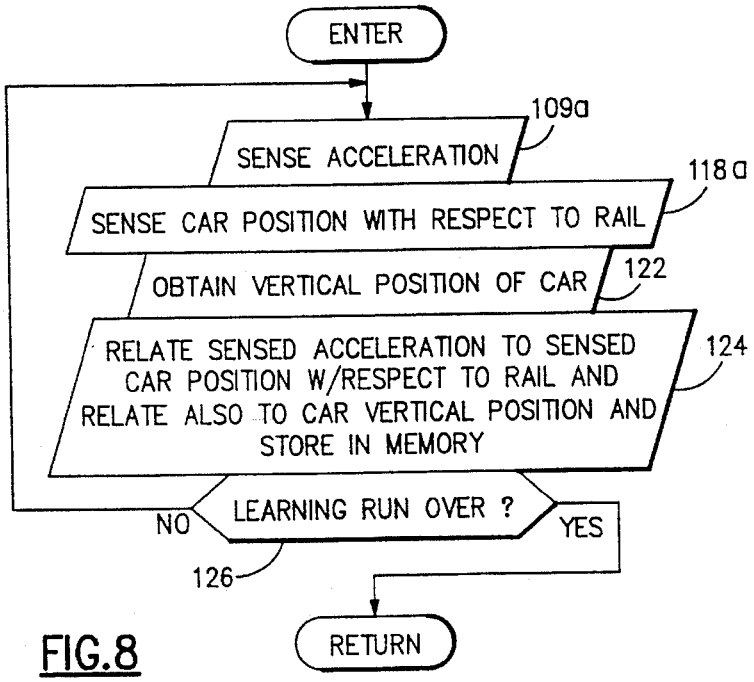
FIG. 8 illustrates steps suitable for execution on a digital signal processor, such as is shown in FIG. 7, for estimating a rail profile along a single axis, according to the present invention.
Figure 7:
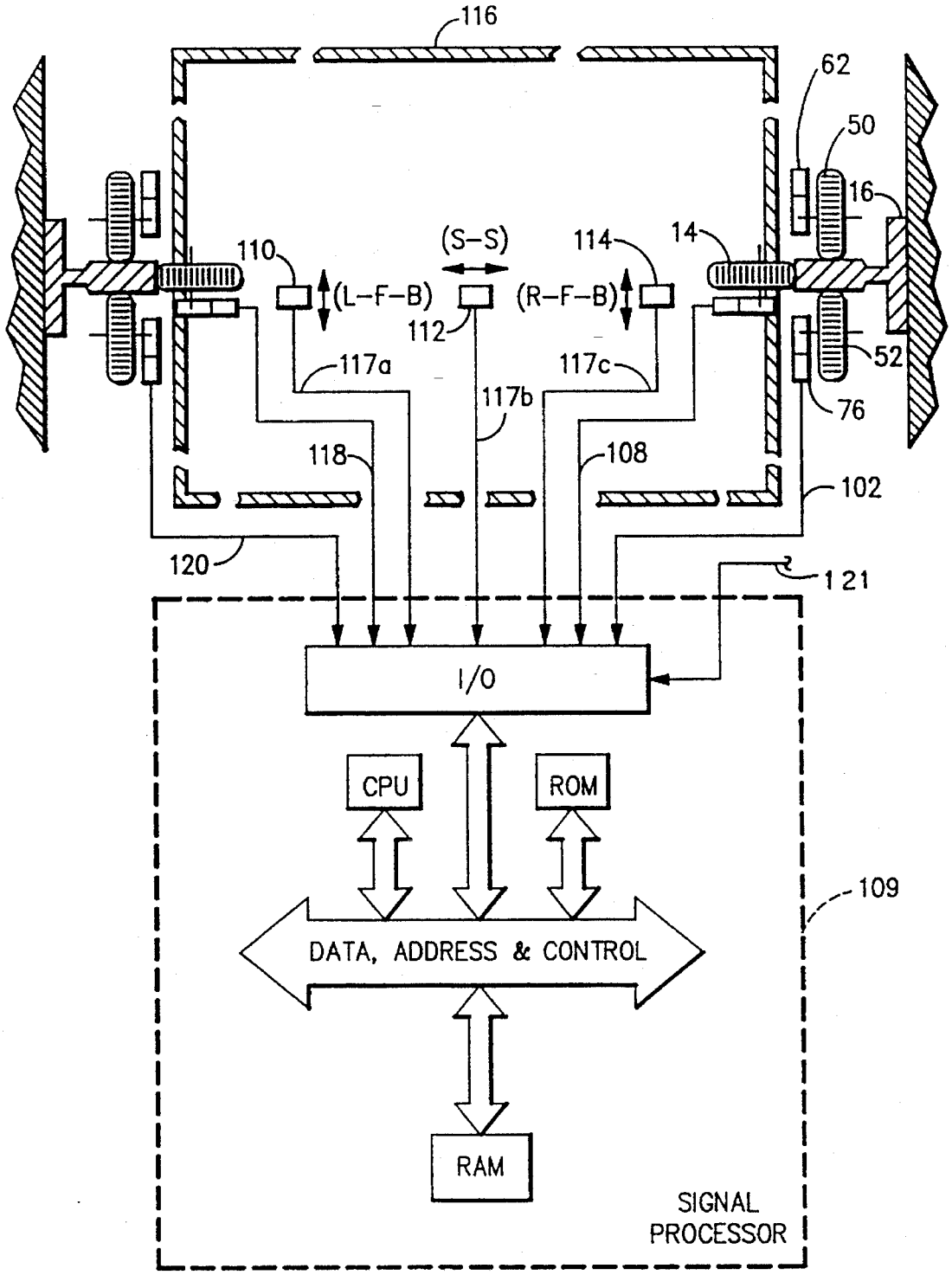
FIG. 7 is an illustration of rail estimation hardware, according to the present invention.

FIG. 7 is an illustration of rail estimation hardware which may be used for carrying out the rail estimation method, according to the present invention. Although the embodiment shown is for gathering a plurality of rail profiles, it should be realized that, in essence, the invention applies to rail estimation in a single axis as shown in FIG. 1, which may of course be practiced, as shown in FIG. 7, in several axes at the same time. The hardware shown in FIG. 7 includes a signal processor 109 which is provided in order to carry out four basic steps as illustrated in FIG. 8: (1) Acceleration Sensing. This may be accomplished, as indicated in a step 109*a*, by using one or more accelerometers depending on the number of profiles to be gathered, for example, three accelerometers 110, 112, 114, located, e.g., at either the top (shown) or bottom of an elevator car frame 116 oriented to measure, respectively, left front-to-back (1-f-b) acceleration as indicated by a signal on a line 117*a*, side-to-side (s-s) acceleration as indicated by a signal on a line 117*b* and right front-to-back (r-f-b) acceleration as indicated by a signal on a line 117*c*; (2) Sensing Car Position With Respect To Rail. Using, for example, one or more relative position sensors, as indicated in a step 118a, in this case four sensors 92, 94; 104 (as shown previously in FIGS. 5 & 6; not shown explicitly in FIG. 7 because the rocker arms, e.g., 62, 76 obscure them in the plan view shown) on the roller guide on the right of the Figure and two others (also not shown) for the left guide, used as relative displacement transducers (e.g., LVDTs, linear potentiometers, gap sensors or the like), for both s—s and f–b displacement measurement at each guide and providing a left side-to-side displacement signal on a line 118, a left front-to-back displacement signal on a line 120, the right side-to-side displacement signal on the line 108, and the right front-to-back displacement signal on the line 102; (3) Obtaining Vertical Position of Car. An indication or measure of the vertical car position is required, such as by means of assignsee's Primary Position Transducer (see U.S. Pat. No. 4,384,275 to Masel et al) or some other manufacturer's vertical position indicating or measured position signal, as indicated in a step 122, and (4) Relating Sensed Acceleration to Sensed Car Position with respect to the Rail To Obtain Rail Displacement from Vertical. As indicated by a step 124, the signal processor 109, data collection computer or the like is used to record the concurrent acceleration, car horizontal position with respect to the rail and car vertical position signals and to process data in such signals using the rail estimation methods disclosed above or in more detail below.

As indicated in a step 126, a decision is made as to whether the car has as yet traversed the full length of the hoistway. If not, the steps 109*a*, 118*a*, 122, 124, 126 are executed again until such time as the rail profile has been obtained.

With regard to the number and positioning of accelerometers, it should be understood that the number and positioning shown is a matter of choice since the acceleration of any point on a plane in the car may theoretically be inferred from merely three accelerometers in that plane. Three accelerometers are shown, one in the center and two on either side near the guides as a matter of computational choice, in this particular case dictated by the decision to treat the left and right front-to-back translations independently of each other. That decision dictated further that they should be placed relatively close to the guides. It should be understood, however, that one could use two such accelerometers together, even placed differently, as manifestations of a single, rotational acceleration (yaw) about a vertical axis. A rotational sensor could even be used.

Similarly, although a particular arrangement and choice of position sensors is shown, it should be realized that other types and arrangements may be used as well. For example, if it is desired to establish a rail profile for a system in which a pure electromagnet actuator is normally fixedly attached to the car with a variable gap between it and the rail, a gap sensor may be used to detect the variations in the gap as the elevator moves vertically. In this way, a similar positional indication of the displacement between the car and rail is obtained.

Figure 9:
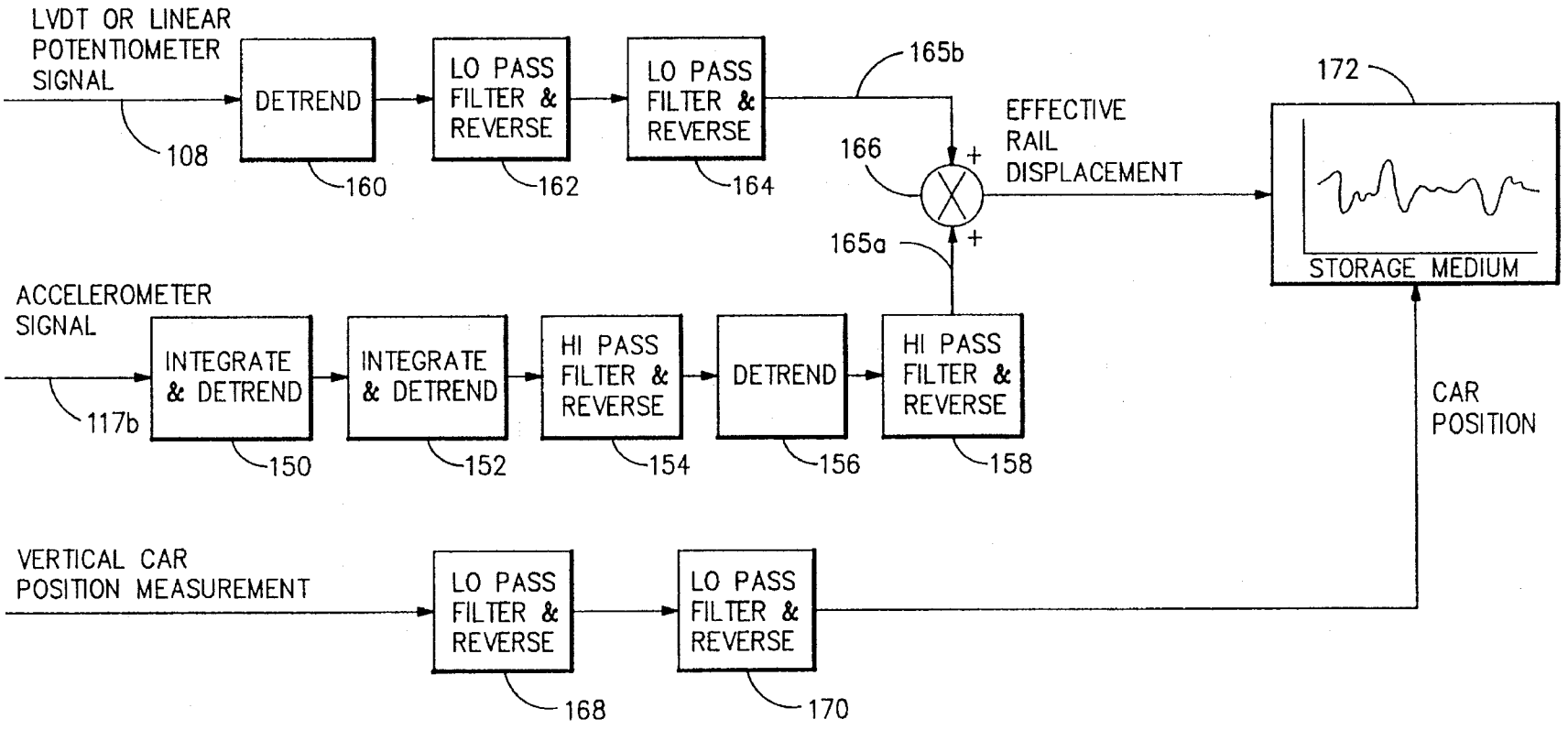
FIG. 9 is similar to FIG. 2 except more detailed.
Figure 10B:
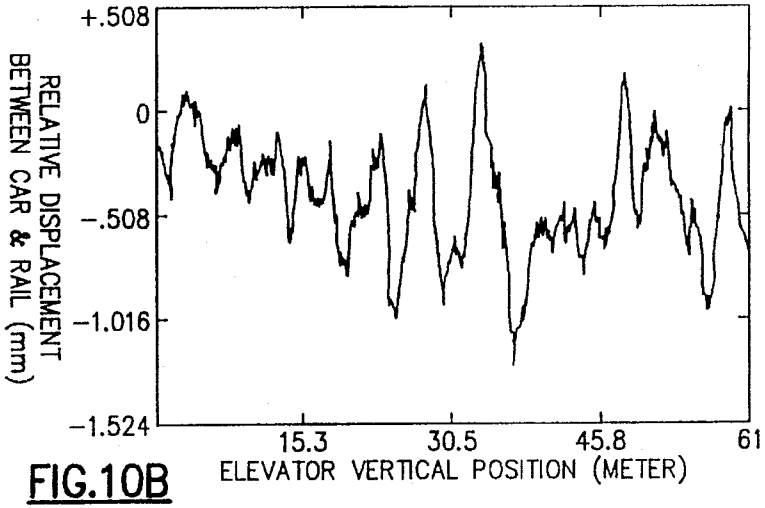
FIGS. 10*b*), 11*b*) & 12*b*) show a horizontal car position with respect to the rail vs. car vertical position for a car load of 228 kilograms located, respectively, at the cab floor center, 94 centimeters to the left of center and 94 centimeters to the right of center, according to the present invention.
Figure 10D:
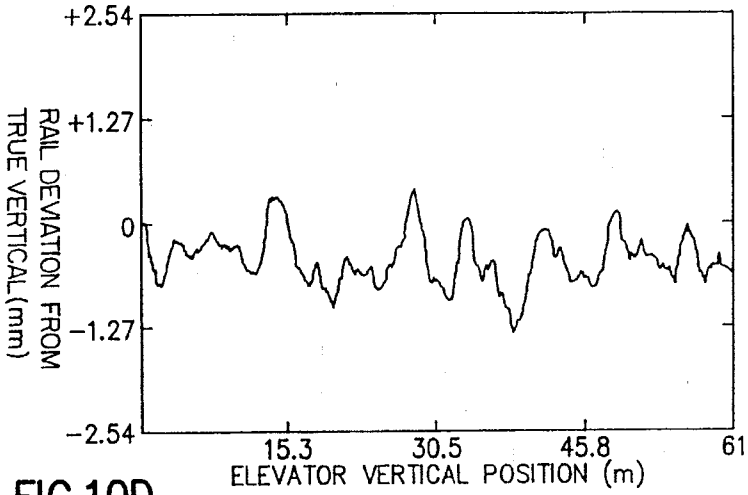
FIGS. 10(*a*), 11(*a*) & 12(*a*) show car acceleration vs. vertical position for a car load of 228 kilograms located, respectively, at the cab floor center, 94 centimeters to the left of center and 94 centimeters to the right of center, according to the teachings of the present invention.
Figure 10A:
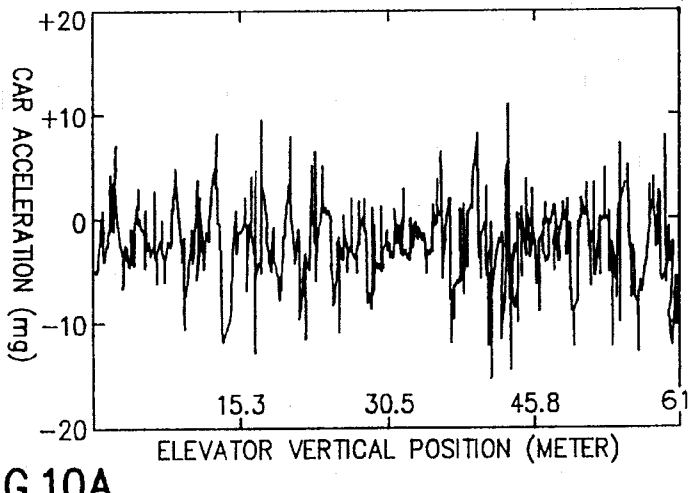
Figure 10C:
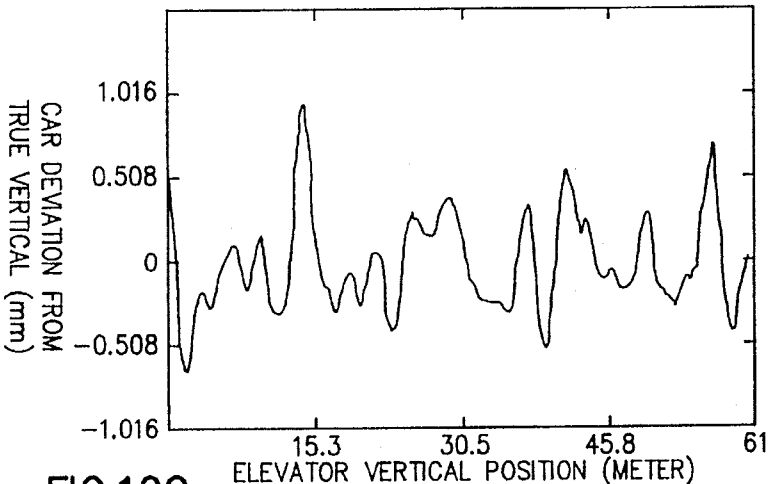
Figure 11A:
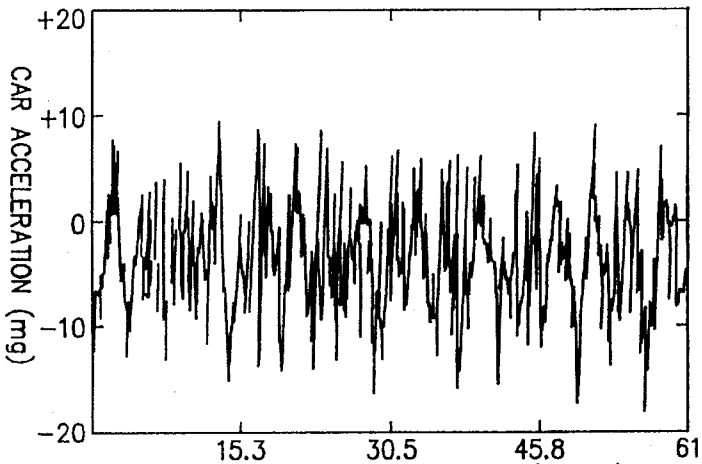
Figure 11B:
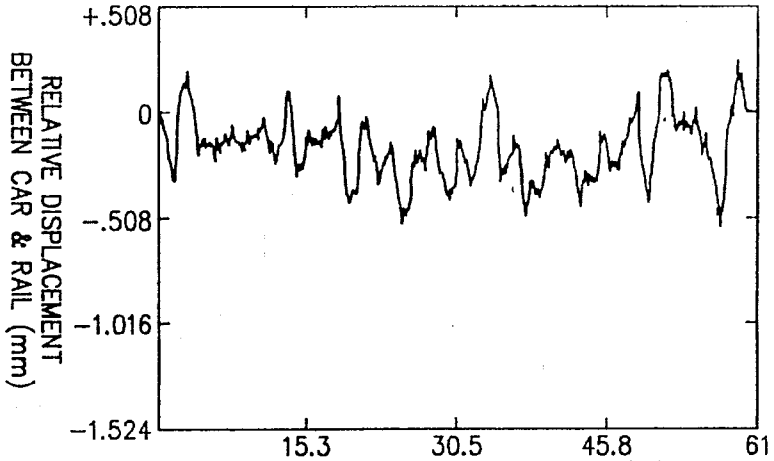
Figure 11C:
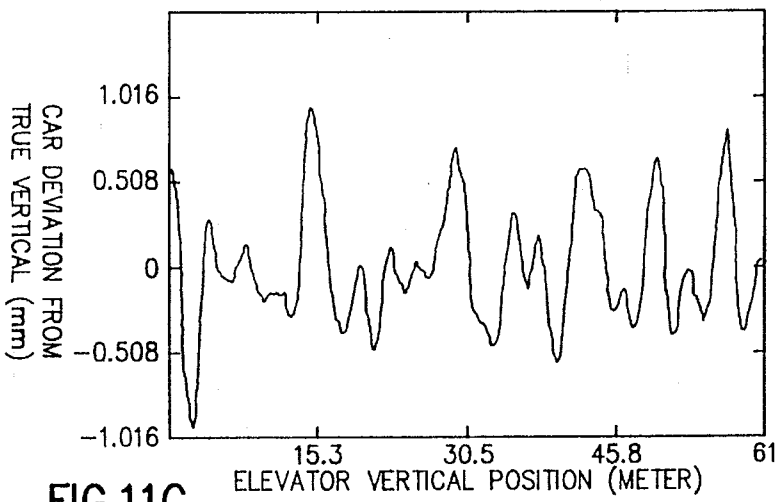
Figure 11D:
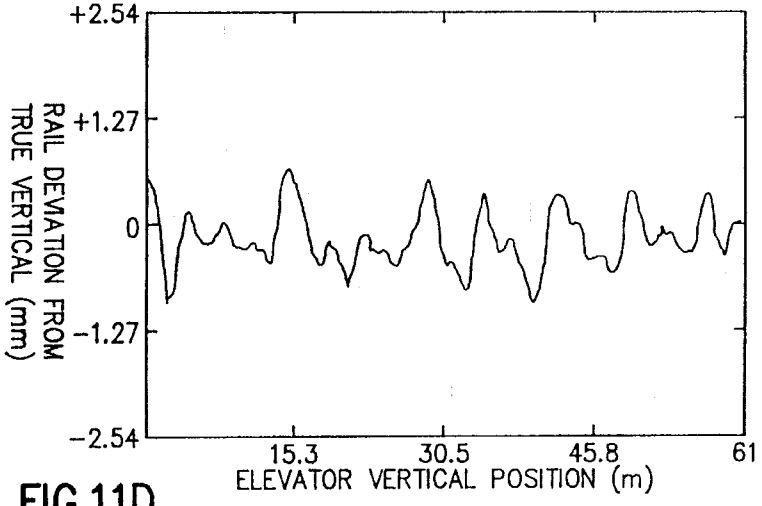
Figure 12B:
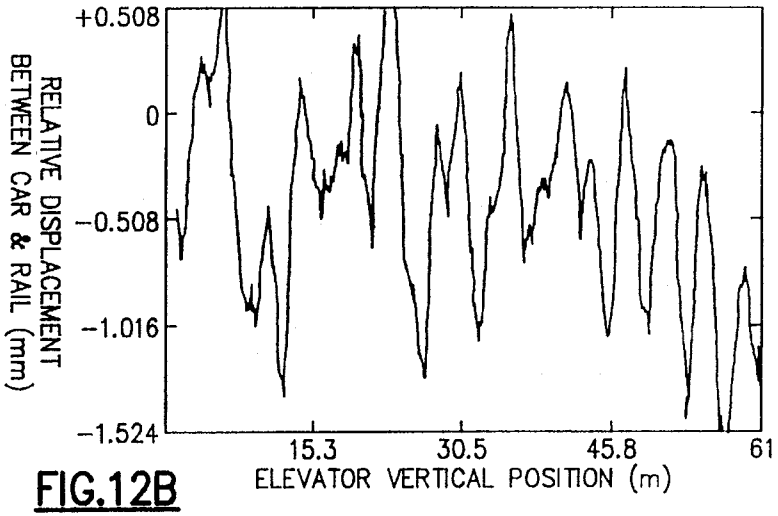
Figure 12D:
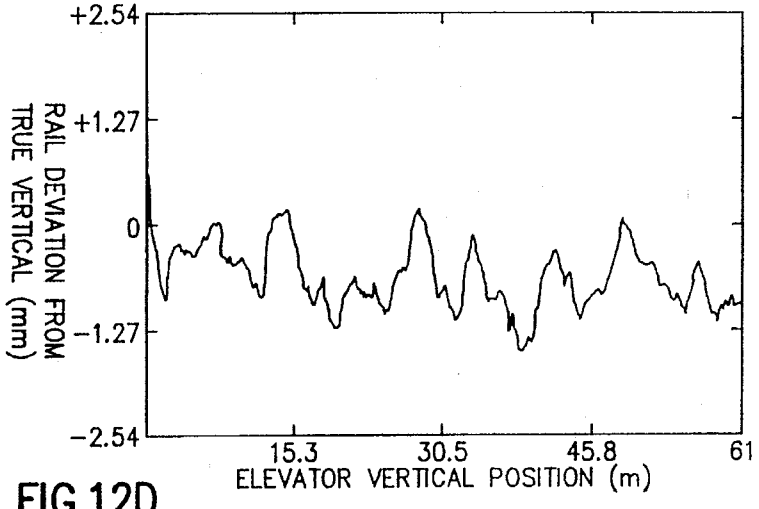
Figure 12A:
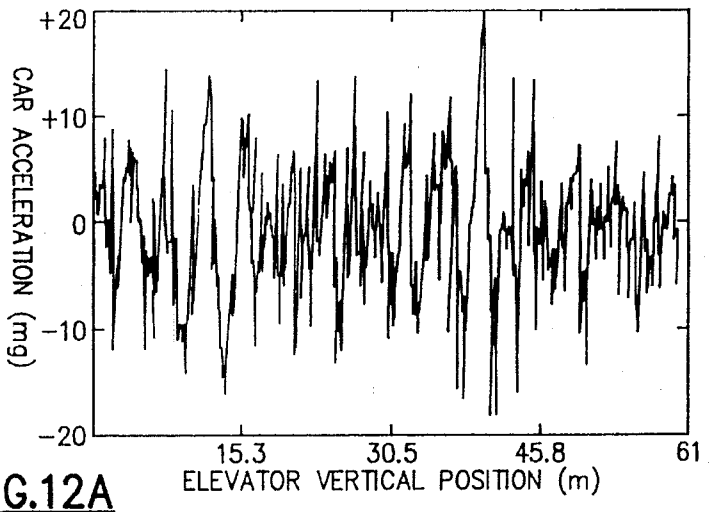
Figure 12C:
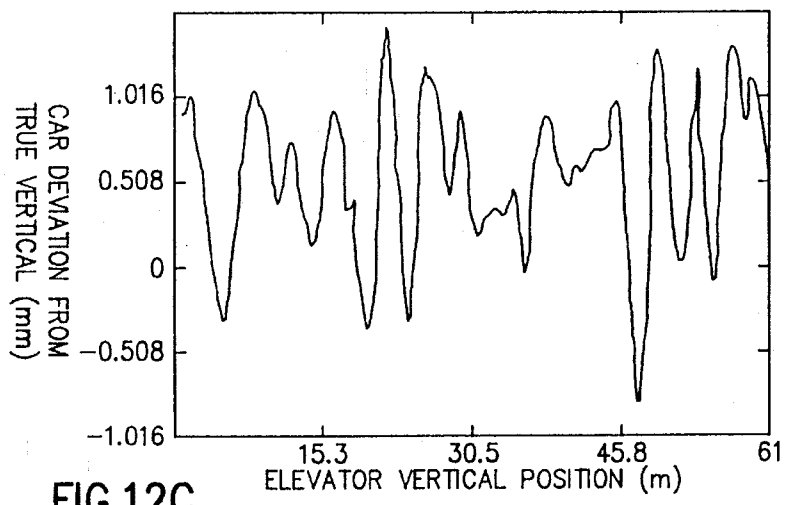

In any event, data is gathered for one or more runs of the elevator car which may, but need not, span its full Operational range The run may be at full, operational range. The run may be full, "contract" speed but need not be. This data may be processed as shown in FIG. 8 to generate one or more rail profiles. FIG. 9 is a more detailed illustration of the processing method shown in FIG. 2 for rail profile estimation in a single axis. This method of estimation may accomplished, for example, by executing a series of steps which are as follows and which may be set up to run in a flow chart for execution on the signal processor 109 in a manner similar to that shown in FIG. 8:

In both steps 150 & 152 integrate and detrend (subtract mean and first moment) the accelerometer output signal on line 117*b* twice;

In a step 154, high pass filter (third order Butterworth with 0.5 Hz breakpoint) the resultant signal, reversing time after the filtering operation to allow additional processing which will minimize phase shift or skew in data;

In a step 156, detrending the result of the filtering and reversal operation of step 154;

In a step 158, again high pass filter the resultant signal from step 156, again reversing time after the filtering operation to allow additional processing which will minimize phase shift or skew in data;

In a step 160, detrend the LVDT or potentiometer signal on the line 108;

In steps 162, 164 low pass filter (third order Butterworth with 20.0 Hz breakpoint) this signal twice, reversing time after each filtering operation to allow additional processing which will minimize phase shift or skew in the LVDT data;

In a step 166, summing the processed accelerometer and LVDT signals to formulate an effective estimate of rail displacement as a function of time; and In steps 168, 170, low pass filter the vertical car position measurement twice, reversing time after each filtering operation to allow additional processing which will minimize phase shifts in this estimate of car position, creating in a step 172, a vertical position reference for the rail profile.

Table I summarizes the various functions that may be carried out in the above described steps as shown in FIG. 9:

TABLE I

| Function | Definition |
|---|---|
| F1 | Integrate<br>Detrend (subtract Mean and 1st moment) |
| F2 | High Pass Filter (3rd order Butterworth with 0.5 Hz breakpoint)<br>Reverse Data in Time |
| F3 | Detrend (subtract Mean and 1st moment) |
| F4 | Low Pass Filter (3rd order Butterworth with 20.0 Hz breakpoint)<br>Reverse Data in Time |

The multi-pass filtering technique described is one method of smoothing data and is discussed in some detail in *Applied Optimal Estimation*, Chapter 5, "Optimal Linear Smoothing" Gelb A. editor MIT Press 1974 Other methods of data smoothing also exist, as discussed for example in *Optimal Filtering*, Chapter 7, "Smoothing of Discrete-Time Signals" Anderson, B. D. O., and J. B. Moore, Prentice-Hall, 1979, which could also be utilized. The selection of filter break points in the smoothing algorithms of the rail estimation system logic is driven by the signal-to-noise characteristics of the sensors and the requirements of the rail estimate for enhancing ride quality. The lateral accelerometer measurements can be corrupted by two types of noise: (1) low frequency noise due to thermally induced electronic drifts and gravity vector misalignments and (2) high frequency electronic noise. Displacement transducers, such as the LVDTs or PPT, are subject to high frequency electronic noise. These parasitic noise effects, however, can be mitigated by filtering to result in rail estimates that are valid within a band of mid-range frequencies, such as the 0.5 to 20 Hz range. This selection of the filter range was determined to be the best compromise between noise reduction and rail estimation requirements based on a developed set of ride quality specifications (International Organization for Standardization (ISO), *Guide for the Evaluation of Human Exposure to Whole-Body Vibration*, Draft International Standard ISO/DIS 2631, Geneva, ISO, 1972), which indicates that humans are most affected by vibration in this frequency range.

The acceleration signals are filtered to remove the low frequency noise below 0.5 Hz. Double integration effectively removes the high frequency noise of those signals. The displacement signals are filtered to remove the high frequency noise above 20 Hz. The resultant rail estimate captures rail anomalies which are present in the frequency range to which humans are most susceptible.

FIGS. 10, 11 and 12 are plots of several of selected signals of FIG. 9, for a high-speed elevator installation (Hoistway No. 4 in the Otis Elevator Company's Bristol, Connecticut Test Tower) for loads of 228 kg at the center of the cab, 228 kg at 94 cm to the left of center and 228 kg at 94 cm to the right of center, respectively, each Figure containing:

(*a*) the acceleration signal on line 117*b* plotted against car vertical position;

(*b*) the car horizontal relative displacement signal (with respect to the rail) on line 108 plotted against car vertical position;

(*c*) the doubly integrated and filtered acceleration signal on line 165*a*;

(*d*) the sum of the signals on lines 165*a* and 165*b*, in each case being a rail profile prediction for the respective load positioning.

As will be apparent, for the three different runs represented by FIGS. 10, 11 & 12, the acceleration and relative displacement data are not repeatable. Thus, if one were to take the approach suggested by Otala, i.e., make an acceleration table, one could not base future behavior on the accelerations gathered during the learning run.

Moreover, as may be seen by comparing FIGS. 10(*c*), 11(*c*) & 12(*c*), even if one were to take Otala's idea one step further and doubly integrate the acceleration signal to at least create a dimensionally correct deviation table, such would not be usable as these plots are not repeatable either.

Only when we follow the teachings of the present invention by summing the signal from any one of the FIGS. 10(*b*), 11(*b*) or 12(*b*) with the respective signal from FIG. 10(*c*), 11(*c*) or 12(*c*), may we obtain a repeatable rail profile as shown in FIGS. 10(*d*), 11(*d*) or 12(*d*).

Although the invention has been shown and described with respect to a best mode embodiment thereof, it should be understood by those skilled in the art that the foregoing and various other changes, omissions and deletions in the form and detail thereof may be made therein without departing from the spirit and scope of this invention.

I claim:

1. A method for measuring horizontal deviations from vertical of an elevator car moving along opposed guide rails in a hoistway, comprising the steps of:

operating the elevator car to traverse the length of the opposed guide rails in the hoistway;

at selected vertical positions in the hoistway, performing the steps, including:

providing a selected elevator car vertical position signal indicative of a selected vertical position of the elevator car along the opposed guide rails;

providing a sensed horizontal acceleration signal indicative of the horizontal acceleration of the elevator car;

providing a sensed horizontal displacement signal indicative of the horizontal displacement of the car in relation to the opposed guide rails;

combining the sensed car horizontal acceleration signal and the sensed horizontal displacement signal;

providing a combined sensed horizontal acceleration and displacement signal for indicating horizontal deviation of the elevator car in relation to the opposed guide rails; and storing in a learned rail memory means the combined sensed horizontal acceleration and displacement signal in a learned-rail memory means indexed according to the selected vertical position.

2. A method for estimating an elevator hoistway rail profile, comprising the steps of:

operating an elevator car to traverse the vertical length of opposed guide rails in said hoistway and providing an elevator car vertical position signal indicative of selected vertical positions of said elevator car in said hoistway;

at selected vertical positions of the elevator car, performing the steps including:

providing a selected elevator car vertical position signal indicative of a selected vertical position of the elevator car along the opposed guide rails;

providing a sensed horizontal acceleration signal indicative of the horizontal acceleration of the elevator car;

doubly integrating the sensed horizontal acceleration signal, for providing a doubly integrated horizontal acceleration signal;

providing a sensed horizontal displacement signal indicative of the horizontal displacement of the car in relation to the opposed guide rails;

summing the sensed horizontal displacement signal and the doubly integrated horizontal acceleration signal, for providing a summed horizontal displacement and doubly integrated acceleration signal; and storing said summed horizontal displacement and doubly integrated acceleration signal according to said vertical position signal at a corresponding one of said selected vertical positions of said elevator car along the opposed guide rails in said hoistway.

3. A method for estimating horizontal deviations of an elevator car moving along opposed guide rails in a hoistway, comprising the steps of:

operating the elevator car to traverse the opposed guide rails of said hoistway;

providing a selected vertical position signal indicative of one of a plurality of selected vertical positions of said car along the opposed guide rails;

sensing a horizontal displacement of the said elevator car in relation to the opposed guide rails and providing a horizontal position signal;

sensing horizontal acceleration of said elevator car and providing an acceleration signal;

doubly integrating said acceleration signal and providing an integrated signal;

summing said horizontal displacement signal and said integrated signal and providing a summed signal indicative of a sensed horizontal deviation of the elevator car in relation to the opposed guide rails; and storing said summed signal according to said car vertical position signal for each of the selected vertical positions along the opposed guide rails in the hoistway.

4. Apparatus for estimating horizontal deviations from vertical of an elevator car moving along opposed guide rails in a hoistway, comprising:

means for operating said elevator to traverse the vertical length of the hoistway;

acceleration means disposed on the elevator car for providing acceleration signals indicative of horizontal acceleration of the elevator car as it traverses the vertical length of the opposed guide rails in the hoistway;

displacement means disposed on the elevator car for providing displacement signals indicative of the displacement of the elevator car in relation to the opposed guide rails as it traverses the vertical length of the hoistway;

vertical primary position sensing means for providing elevator car vertical position signals indicative of the vertical position of the car along the opposed guide rails of the hoistway as it traverses the vertical length of the hoistway;

signal processing means, responsive to said acceleration signals, said displacement signals and said elevator car vertical position signals, having learned-rail memory means for successively storing said acceleration signals and said displacement signals indexed according to said elevator car vertical position signals; and means for providing a plurality of signals, each indicative of an approximate displacement of the opposed guide rails with respect to a vertical reference at a given point along the opposed guide rails uniquely indicated by said elevator car vertical position signals, each derived from a sum of a corresponding one of said displacement signals with a double integral of a related one of said acceleration signals.

5. A method for estimating horizontal deviations from vertical of an elevator car moving along opposed guide rails in a hoistway, comprising the steps of:

operating an elevator car to travel the vertical length of the hoistway;

obtaining vertical position signals indicative of said car's position along the opposed guide rails in said hoistway as said car travels along said hoistway;

for each of a large number of vertical positions separately indicated by said vertical position signals sensing a horizontal displacement of said elevator car in relation to said opposed guide rails and providing a horizontal position signal indicative of the horizontal displacement;

sensing a horizontal acceleration of said elevator car and providing an acceleration signal indicative of the horizontal acceleration;

doubly integrating said acceleration signal and providing an integrated signal;

summing said horizontal displacement signal and said integrated signal and providing a summed signal indicative of the sum of said position signal and said integrated signal; and storing said summed signal according to the vertical position indicated by a related one of said vertical position signals.

6. A method for measuring horizontal deviations from vertical of an elevator car moving along opposed guide rails installed vertically in a hoistway, comprising the steps of:

moving an elevator car to vertically traverse the hoistway;

providing a vertical position signal indicative of vertical position of the elevator car as it traverses the hoistway;

sensing horizontal accelerations of the elevator car as it moves vertically along the opposed guide rails for providing a sensed acceleration signal;

sensing horizontal position of the elevator car with respect to the opposed guide rails for providing a sensed car position signal as the elevator car traverses the hoistway; and at selected vertical positions in the hoistway, relating the sensed acceleration signal and the sensed car position signal, and providing a rail horizontal displacement from vertical signal for each of the selected vertical positions, wherein the step of relating comprises a step of summing the sensed acceleration signal and the sensed car position signal.

7. The method of claim 6, wherein the step of relating includes the steps of:

twice integrating and detrending the sensed acceleration signal for providing a twice integrated and detrended acceleration signal;

once high pass filtering and reversing in time the twice integrated and detrended acceleration signal for providing a once high pass filtered acceleration signal;

detrending the once high pass filtered acceleration signal for providing a detrended once high pass filtered signal;

twice high pass filtering and reversing in time the detrended once high pass filtered signal for providing a twice filtered acceleration signal;

detrending the sensed car position signal for providing a detrended car position signal;

twice low pass filtering and reversing in time the detrended car position signal for providing a twice filtered car position signal;

summing the twice filtered acceleration signal and the twice filtered car position signal for providing a rail horizontal deviation from vertical signal for storing according to the selected vertical position.

8. The method of claim 6, further comprising the step of storing the rail displacement from vertical signal for each of the selected vertical positions.

9. Apparatus for measuring horizontal deviations from vertical of opposed elevator car rails installed vertically in a hoistway comprising:

means for sensing horizontal accelerations of the car as it moves vertically along the opposed guide rails for providing a sensed acceleration signal;

means for sensing horizontal position of the car with respect to the opposed guide rails for providing sensed car position signals; and means responsive to the sensed acceleration signal, the sensed car position signals and a vertical position signal, for relating the sensed acceleration signal to the sensed car position signals at selected vertical positions in the hoistway, for providing replacement from vertical signals for each of said opposed guide rails for each of the selected vertical positions, wherein the means for relating comprises means for summing, for each of said opposed guide rails, the sensed acceleration signal and a corresponding one of the sensed car position signals.

10. Apparatus for measuring horizontal deviations from vertical of an elevator car rail installed vertically in a hoistway comprising:

means for sensing horizontal accelerations of the car as it moves vertically along the rail, for providing a sensed acceleration signal;

means for sensing horizontal position of the car with respect to the rail, for providing a sensed car position signal; and means responsive to the sensed acceleration signal, the sensed car position signal and a vertical position signal, for relating the sense acceleration signal to the sensed car position signal at selected vertical positions in the hoistway, for providing a rail displacement from vertical signal for each of the selected vertical position, wherein the means for relating includes:

means responsive to the sensed acceleration signal for twice integrating and detrending the sensed acceleration signal for providing a twice integrated and detrended acceleration signal;

means responsive to the twice integrated and detrended acceleration signal for first high pass filtering and reversing in time the twice integrated and detrended acceleration signal for providing a once high pass filtered acceleration signal;

means responsive to the once high pass filtered acceleration signal for detrending the once high pass filtered acceleration signal for providing a detrended once high pass filtered signal;

means responsive to the detrended once high pass filtered signal for twice high pass filtering and reversing in time the detrended once high pass filtered signal for providing a twice filtered acceleration signal;

means responsive to the sensed car position signal for detrending the sensed car position signal for providing a detrended car position signal;

means responsive to the detrended car position signal for twice low pass filtering and reversing in time the detrended car position signal for providing a twice filtered car position signal; and summing means, responsive to the twice filtered car position signal and the twice filtered acceleration signal for summing the twice filtered acceleration signal and the twice filtered car position signal for providing a rail horizontal deviation from vertical signal for storing according to the selected vertical position.

11. The apparatus of claim 9, further comprising storage means, responsive to the vertical position signal and to the rail displacement from vertical signals, for storing the rail displacement from vertical signals for each of the selected vertical positions.

12. Apparatus for estimating horizontal deviations from vertical of an elevator car moving along opposed guide rails in a hoistway, comprising:

means for operating the elevator car to traverse the vertical length of the opposed guide rails in said hoistway;

means for providing a selected elevator car vertical position signal indicative of a selected vertical position of the elevator car moving along the opposed guide rails;

means for providing a sensed horizontal acceleration signal indicative of a horizontal acceleration deviation of the elevator car that vertically traverses said length of said hoistway;

means for providing a sensed displacement signal indicative of a horizontal displacement deviation of the elevator car in relation to the opposed guide rails;

integrating means, responsive to the sensed acceleration signal, for doubly integrating said sensed acceleration signal, for providing an integrated signal indicative of a horizontal displacement of said elevator car, and summing means, responsive to the sensed displacement signal, and further responsive to said integrated signal, for providing a summed horizontal displacement signal; and learned-rail memory means, responsive to said selected elevator car vertical position signal, and further responsive to said summed horizontal displacement signal, for storing said summed horizontal displacement signal indexed according to said selected vertical position signal at the selected vertical positions of said elevator car.

13. Apparatus for estimating horizontal deviations from vertical of an elevator car moving along opposed guide rails in a hoistway, comprising:

means for operating the elevator car to traverse the vertical length of the opposed guide rails in said hoistway;

means for providing a selected elevator car vertical position signal indicative of a selected vertical position of the elevator car moving along the opposed guide rails;

means for providing a sensed horizontal acceleration signal indicative of a horizontal acceleration deviation of the elevator car that vertically traverses said length of said hoistway;

means for providing a sensed displacement signal indicative of a horizontal displacement deviation of said elevator car in relation to the opposed guide rails;

learned-rail memory means, positive to said selected elevator car vertical position signal, further responsive to said sensed horizontal displacement signal, and further responsive to said sensed horizontal acceleration signal, for storing said horizontal displacement signal and said horizontal acceleration signal indexed according to said selected vertical position signal at the selected vertical position of said elevator car, and for providing a stored sensed acceleration signal and a stored sensed displacement signal;

integrating means, responsive to the stored sensed acceleration signal, for doubly integrating said stored sensed acceleration signal, for providing an integrated signal indicative of a horizontal displacement of said elevator car; and summing means, responsive to the stored sensed displacement signal, and further responsive to said integrated signal, for providing a summed horizontal displacement signal.

14. A method for measuring horizontal deviations from vertical of an elevator car moving along opposed guide rails in a hoistway, comprising the steps of:

operating the elevator car to traverse the length of the opposed guide rails in the hoistway;

at selected vertical positions in the hoistway, performing the steps, including:

providing a selected elevator car vertical position signal indicative of a selected vertical position of the elevator car along the opposed guide rails;

providing a first sensed signal indicative of a horizontal force on the elevator car;

providing a second sensed signal indicative of a horizontal displacement of the elevator car in relation to the opposed guide rails;

combining the first sensed signal and the second sensed signal, for providing a combined signal indicative of a horizontal deviation of the elevator car in relation to the opposed guide rails; and storing in a learned rail memory means the combined signal in a learned-rail memory means indexed according to the selected vertical position.

15. A method according to claim 14, wherein said first sensed signal is a sensed horizontal acceleration signal indicative of a horizontal acceleration of the elevator car.

* * * * *